US008029320B1

(12) United States Patent
Lustig et al.

(10) Patent No.: US 8,029,320 B1
(45) Date of Patent: Oct. 4, 2011

(54) INTEGRATED MODULE INCLUDING PHYSICAL LAYER NETWORK DEVICE, RECEPTACLE AND PHYSICAL LAYER ISOLATION MODULE

(75) Inventors: Haim Lustig, Zichron Yaakov (IL); Zeev Khaikin, Haifa (IL); Jamyuen Ko, Santa Clara, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 12/946,663

(22) Filed: Nov. 15, 2010

(51) Int. Cl.
*H01R 13/66* (2006.01)

(52) U.S. Cl. ..... 439/620.01

(58) Field of Classification Search ..... 439/620.01, 439/620.15, 92, 607.01
See application file for complete search history.

(56) References Cited

U.S. PATENT DOCUMENTS 6,381,283 B1 * 4/2002 Bhardwaj et al. ..... 375/257
7,309,260 B2 * 12/2007 Brower et al. ..... 439/676
7,460,375 B2 * 12/2008 Randall et al. ..... 361/724
2005/0106939 A1 * 5/2005 Zhang et al. ..... 439/607
2007/0015416 A1 * 1/2007 Gutierrez et al. ..... 439/676
2008/0268677 A1 * 10/2008 Hsu ..... 439/92
2010/0049893 A1 * 2/2010 Drako ..... 710/301
2010/0128432 A1 * 5/2010 Miller ..... 361/679.54

OTHER PUBLICATIONS

Halo Electronics, Inc. (Oct. 2004). Halo Announces a Full Line of Vertical FastJacks™ [Press Release]. Mountain View, CA: Halo Electronics, Inc.
Halo Electronics, Inc. (2010). 10GBASE-T 24 Pin Isolation/Filter Modules [Datasheet]. (Revised Mar. 2010). Mountain View, CA: Halo Electronics, Inc.
SMSC® Success by Design. (2008). High Performance Single Chip Low Power 10/100 Etherenet Physical Layer Transceiver (PHY) [Datasheet LAN83C185]. (Revision 0.8 (Jun. 12, 2008), Hauppauge, NY: SMSC® Success by Design. 1-60.

* cited by examiner

*Primary Examiner* — Chandrika Prasad
(74) *Attorney, Agent, or Firm* — Christopher K. Gagne

(57) ABSTRACT

An embodiment may include an integrated module that may include a physical layer network device and a cable connector receptacle. The physical layer network device may be physically and electrically coupled to the cable connector receptacle. The physical layer network device may include a circuit board. The circuit board may be directly physically coupled to the receptacle. The circuit board also may be electrically coupled to the receptacle. Many alternatives, variations, and modifications are possible.

14 Claims, 5 Drawing Sheets

100

100'

INTEGRATED MODULE INCLUDING PHYSICAL LAYER NETWORK DEVICE, RECEPTACLE AND PHYSICAL LAYER ISOLATION MODULE

FIELD

This disclosure relates to an integrated module for use in network connectivity.

BACKGROUND

In one conventional host computer, the host includes an motherboard to which are mounted a chipset, an Ethernet PHY device, and an Ethernet connector module. The chipset is electrically connected to the PHY device, and the PHY device is electrically connected to the connector module. The module includes an RJ45 connector and an Ethernet physical layer isolation module. The PHY device and Ethernet connector module each have separate respective footprints, and are mounted to different respective locations on the motherboard, and therefore, consume multiple areas of the motherboard. As result, the PHY device and connector module may take up more motherboard surface area than is desirable.

BRIEF DESCRIPTION OF THE SEVERAL VIEWS OF THE DRAWINGS

Features and advantages of embodiments will become apparent as the following Detailed Description proceeds, and upon reference to the Drawings, wherein like numerals depict like parts, and in which.

Although the following Detailed Description will proceed with reference being made to illustrative embodiments, many alternatives, modifications, and variations thereof will be apparent to those skilled in the art. Accordingly, it is intended that the claimed subject matter be viewed broadly.

DETAILED DESCRIPTION

Figure 1:
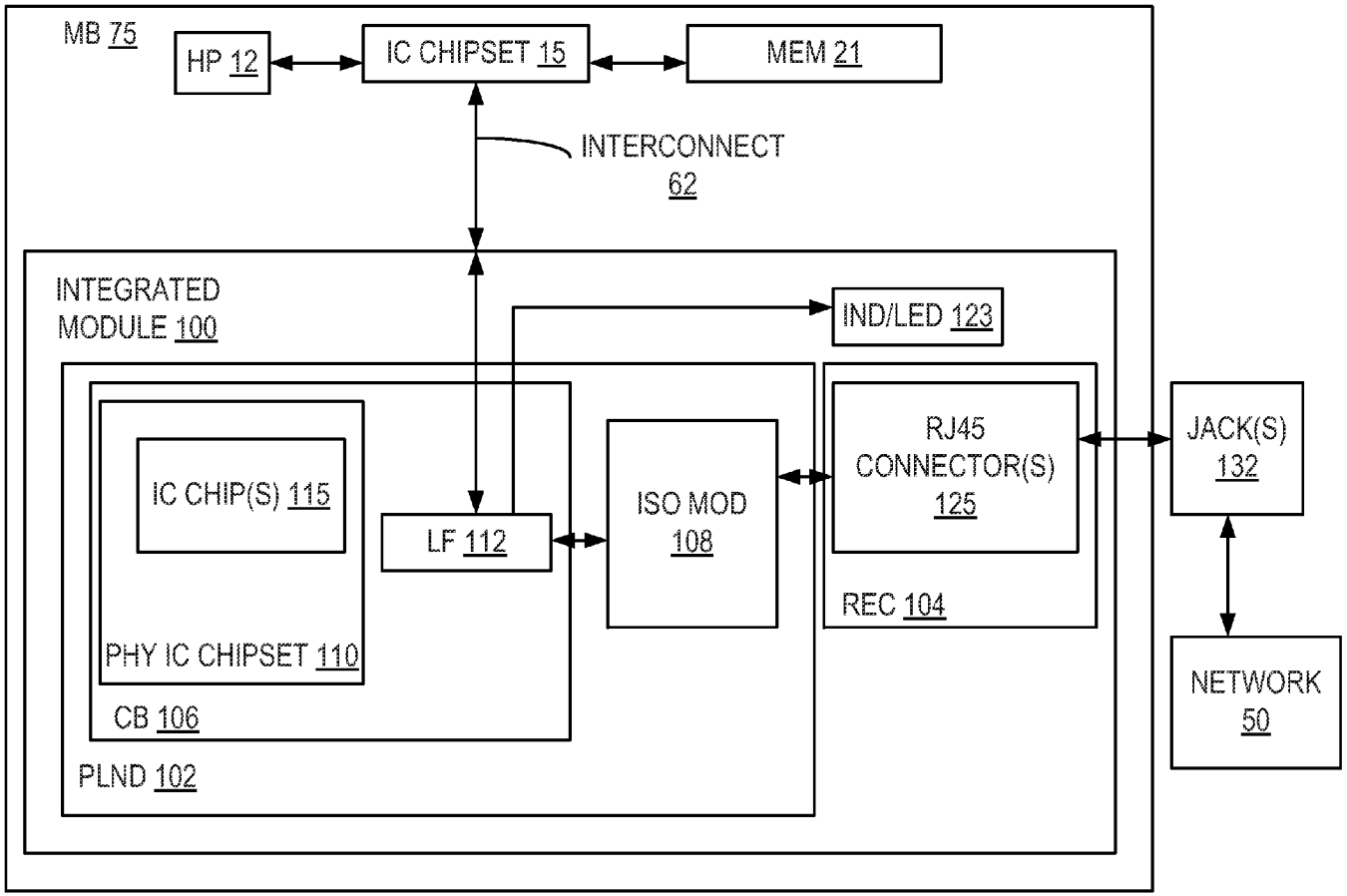
FIG. 1 illustrates a system embodiment.

FIG. 1 illustrates a system embodiment 101. System 101 may include an integrated module 100 that may be physically mounted to and/or on host computer motherboard (MB) 75. In this embodiment, module 100 may comprise a physical layer network device (PLND) 102, physical layer isolation module 108, and/or network connector receptacle 104. Device 102 may comprise, for example, a circuit board (CB) 106 that may comprise a physical integrated circuit chipset 110 and/or lead frame (LF) 112. Chipset 110 may comprise one or more integrated circuit chips 115. Chipset 110 and/or one or more chips 115 may be physically mounted to circuit board 106 and/or may be physically and/or electrically coupled to lead frame 112.

Lead frame 112 may be physically and/or electrically coupled to one or more indicators and/or light emitting diodes 123, and/or to isolation module 108. One or more indicators 123 may be comprised in module 100. Alternatively, without departing from this embodiment, one or more indicators 123 may not be comprised in module 100, and may be separately mounted (e.g., not as part of module 100) to motherboard 75.

Isolation module 108 may be physically and/or electrically coupled to receptacle 104. Receptacle 104 may comprise one or more RJ45 connectors 125. One or more connectors 125 may be constructed in such a way as to permit one or more Ethernet connector jacks 132 to be physically inserted into and/or mated with receptacle 104 and/or one or more connectors 125. When one or more jacks 132 are inserted into and/or mated with receptacle 104 and/or one or more connectors 125, one or more jacks 132 may become electrically coupled to chipset 110 and/or one or more chips 115 via one or more connectors 125, receptacle 104, module 108, lead frame 112, and/or circuit board 106. When one or more jacks 132 are electrically coupled to chipset 110, chipset 110 may be electrically coupled to one or more networks 50 via one or more jacks 132.

In this embodiment, integrated circuit chipset 15, one or more host processors (HP) 12, and/or computer readable/writable system memory 21 also be mounted to motherboard 75. One or more HP 12 may be electrically coupled via the chipset 15 to memory 21. Chipset 15 may be electrically coupled to one or more board-level interconnects 62 comprised in motherboard 75. Lead frame 112 may be electrically coupled to chipset 15 via one or more interconnects 62.

When chipset 110 is electrically coupled to one or more networks 50 via one or more jacks 132, this may permit chipset 110, one or more HP 12, and/or chipset 15 may be electrically and/or communicatively coupled to one or more hosts (not shown) in and/or accessible via one or more networks 50. Additionally, host motherboard 75 may be comprised in another host computer (not shown). When chipset 110, one or more HP 12, and/or chipset 15 are electrically and/or communicatively coupled to one or more hosts in and/or accessible via one or more networks 50, one or more indicators 123 may indicate, at least in part, status of communication and/or connection with and/or via these one or more hosts and/or one or more networks 50.

In this embodiment, the terms "host computer," "host," "server," "client," "network node," and "node" may be used interchangeably, and may mean, for example, without limitation, one or more end stations, mobile internet devices, smart phones, media devices, input/output (I/O) devices, tablet computers, appliances, intermediate stations, network interfaces, clients, servers, and/or portions thereof. In this embodiment, a "network" may be or comprise any mechanism, instrumentality, modality, and/or portion thereof that permits, facilitates, and/or allows, at least in part, two or more entities to be communicatively coupled together. Also in this embodiment, a first entity may be "communicatively coupled" to a second entity if the first entity is capable of transmitting to and/or receiving from the second entity one or more commands and/or data. In this embodiment, data and information may be used interchangeably, and may be or comprise one or more commands (for example one or more program instructions), and/or one or more such commands may be or comprise data and/or information. Also in this embodiment, an "instruction" may include data and/or one or more commands.

In this embodiment, a chipset may comprise, for example, memory, network controller, and/or input/output controller circuitry. Additionally, in this embodiment, an integrated circuit or a chip may be or comprise one or more microelectronic devices embodied, at least in part, and/or comprised, at least in part, in and/or as one or semiconductor substrates and/or dies. Although not shown in the Figures, some or all of the functionality and/or components of chipset 15 may be comprised in, for example, in one or more host processors 12. In this embodiment, a "device" may comprise circuitry capable of, at least in part, receiving, processing, and/or transmitting data and/or one or more commands. Also in this embodiment, "circuitry" may comprise, for example, singly or in any combination, analog circuitry, digital circuitry, hardwired circuitry, programmable circuitry, co-processor circuitry, state machine circuitry, and/or memory that may comprise program instructions that may be executed by programmable circuitry. Also in this embodiment, a processor and controller each may comprise respective circuitry capable of performing, at least in part, one or more arithmetic and/or logical operations, such as, for example, one or more respective central processing units. Memory 21 may comprise one or more of the following types of memories: semiconductor firmware memory, programmable memory, non-volatile memory, read only memory, electrically programmable memory, random access memory, flash memory, magnetic disk memory, optical disk memory, and/or other or later-developed computer-readable and/or writable memory.

In this embodiment, a portion of an entity may comprise all or less than all of the entity. Also in this embodiment, an integrated module may be or comprise a plurality of functional and/or physical entities that are and/or have been combined, at least in part, to form, result in, and/or constitute, at least in part, a single logical, physical, and/or functional entity. In this embodiment, an integrated module may be of, or comprise, at least in part, unitary construction. Alternatively, without departing from this embodiment, an integrated module may be or comprise, at least in part, multiple independently constructed portions combined so as to form a single entity. Additionally, in this embodiment, a physical layer network device may be a device that is capable, at least in part, in performing, at least in part, one or more physical layer network operations. Such operations may be related to, resulting in, involving, comprising, and/or facilitating physical transmission and/or reception of one or more signals via a network, such as, for example, a PHY device. Many other and/or additional alternatives and/or modifications are possible without departing from this embodiment.

In this embodiment, one or more HP 12, chipset 15, chipset 110, and/or one or more chips 115 may be capable of exchanging data and/or commands with and/or via one or more networks 50 in accordance with one or more communication protocols. For example, in this embodiment, these one or more protocols may be compatible with, e.g., an Ethernet protocol and/or Transmission Control Protocol/Internet Protocol.

This Ethernet protocol may comply or be compatible with the Gigabit Ethernet protocol described in Institute of Electrical and Electronics Engineers, Inc. (IEEE) Std. 802.3-2008, published in 2008. This TCP/IP protocol may comply or be compatible with the protocols described in Internet Engineering Task Force (IETF) Request For Comments (RFC) 791 and 793, published September 1981. Many different, additional, and/or other protocols (including, for example, those stated above) may be used for such data and/or command exchange without departing from this embodiment (e.g., earlier and/or later-developed versions of the aforesaid and/or other protocols).

Additionally, in this embodiment, an interconnect may comprise any mechanism for communicatively coupling at least two entities. Also in this embodiment, a board-level interconnect may comprise an interconnect comprised and/or used in, at least in part, a motherboard and/or circuit board. In this embodiment, one or more interconnects 62 may be or comprise one or more peripheral component interconnect express (PCI-E) board-level interconnects that may be comply and/or be compatible with, for example, PCI Express™ Base Specification Revision 1.0, Jul. 22, 2002, PCI-SIG. Many different, additional, and/or other types of interconnects protocols (including, for example, those stated above) may be used for such data and/or command exchange without departing from this embodiment (e.g., earlier and/or later-developed versions of the aforesaid and/or other protocols).

Figure 2:
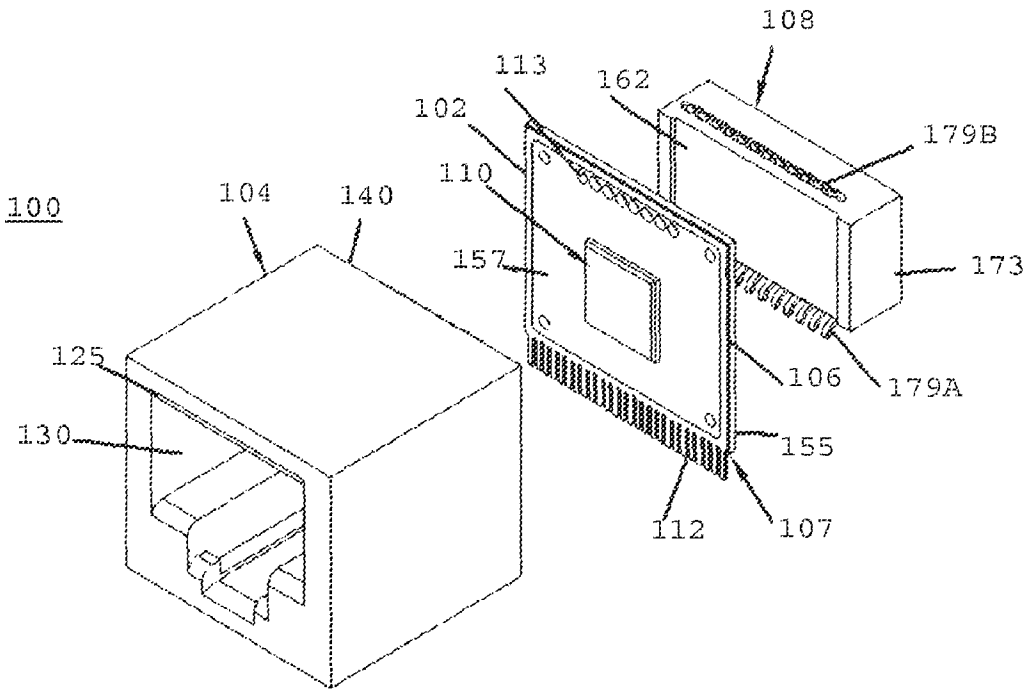
FIG. 2 illustrates an exploded, perspective view of an integrated module in an embodiment.
Figure 3:
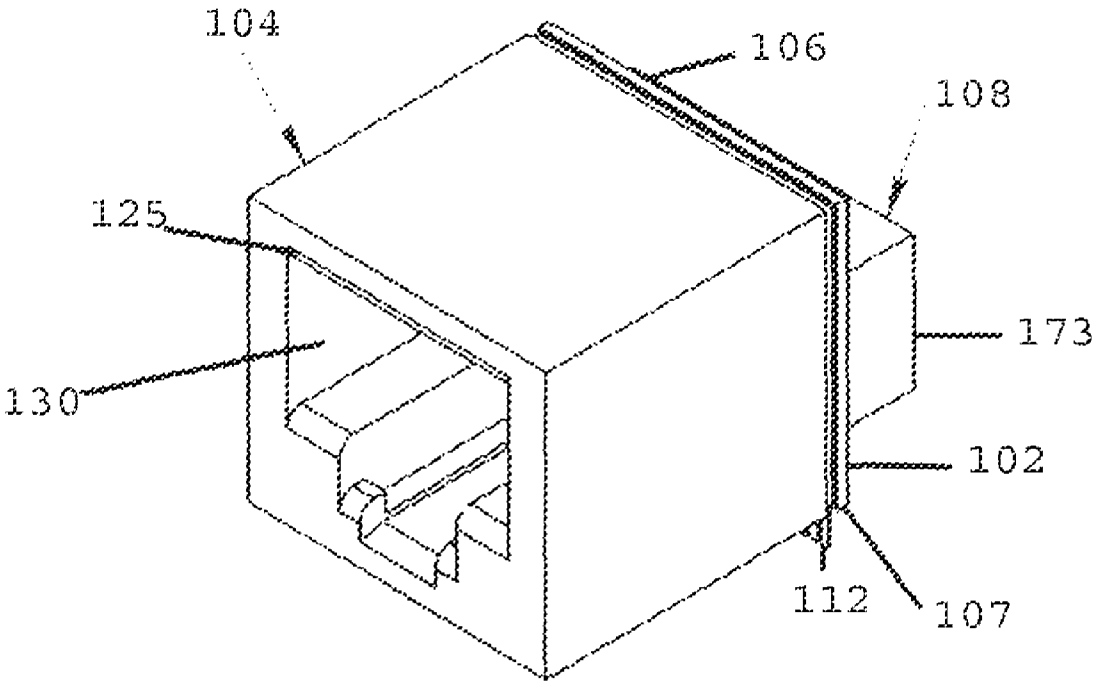
FIG. 3 illustrates a perspective view of an integrated module in an embodiment.

With reference now being made to FIGS. 1-5, the advantageous physical construction of integrated module 100 in an embodiment will be described. FIG. 2 illustrates a perspective, exploded view of integrated module 100 in an embodiment, to show various components of the module 100. FIG. 3 illustrates a perspective view of the module 100, as constructed, in this embodiment. As shown in FIGS. 2-3, module 100 may comprise physical layer network device 102 that may comprise PHY integrated circuit chipset 110 directly physically mounted to a (e.g., generally planar) surface 157 of a generally cuboidic substrate 107 of circuit board 106. Circuit board 106 may comprise another, opposite (e.g., generally planar) surface 155 that may be oppositely facing from (e.g., with respect to) surface 157. Surface 157 and/or chipset 110 may be directly physically coupled (e.g., mounted) to, and/or in intimate physical contact with, an external (e.g., generally planar) surface 140 of RJ45 receptacle 104.

In this embodiment, receptacle 104 may comprise a generally cubic or cuboidic, electrically insulating housing that comprises an opening 130 dimensioned and/or otherwise provisioned (e.g., mechanically and/or electrically) to receive one or more connector RJ45 jacks 132 (opening 130 may be constructed so as to permit one or more jacks 132 to be plugged into receptacle 104 via opening 130, and thereby to become physically and electrically coupled to receptacle 104). For example, receptacle 104 may comprise connector 125 to come into contact with and become electrically coupled to one or more jacks 132 when one or more jacks 132 are plugged into receptacle 104. Opening 130 may be formed in a surface of the cuboidic housing of receptacle 104 that is oppose (e.g., oppositely facing relative) to surface 140.

Circuit board 106 may comprise lead frame 112. One or more portions of frame 112 may be electrically and physically coupled to chipset 110 and/or one or more chips 115. One or more portions of frame 112 also may be electrically and physically coupled, at least in part, to one or more interconnects 62, and thereby, may electrically and physically couple chipset 110 and/or one or more chips 115 to chipset 15. Isolation module 108 may comprise, for example, a generally cuboidic, electrically insulating, integrated circuit package 173 that comprises a surface 162 that may be physically mounted to and/or in intimate contact with surface 155 of circuit board 106.

Electrically conductive leads 179A of module 108 may extend from package 173 and may be physically and electrically coupled, at least in part, to chipset 110 and/or one or more chips 115 via one or more portions of frame 112. Electrically conductive leads 179B of module 108 may extend from package 173 and through vias or openings 113 in circuit board 106, and may be physically and electrically coupled, at least in part, through the housing of the receptacle 104, to connector 125 of receptacle 104. As a result, the connector 125 of receptacle 104 may be electrically coupled, via module 108, to one or more portions of frame 112 of circuit board 106, and therefore, also may be electrically coupled, via these one or more portions of frame 112, to chipset 110 and/or one or more chips 115. Module 108 may provide, for example, electrical isolation, insertion loss, and/or return loss in accordance with, for example, Gigabit Ethernet protocol. Thus, in this embodiment, isolation module 108 may electrically couple the circuit board 106 to the receptacle 104, and the isolation module 108 may be physically mounted both to the receptacle 104 and to the circuit board 106.

In this embodiment, surface 157 of circuit board 106 may be mounted to surface 140 of receptacle 104 such that surface 157 may cover, at least in part, surface 140, or vice versa. For example, as shown in FIG. 3, surface 157 and surface 140 may have substantially identical or identical respective dimensions and/or surface areas, such that, in module 100, surface 157 may substantially or entirely cover surface 140. Alternatively, without departing from this embodiment, surface 157 may be undersized compared to surface 140, or vice versa.

Also, in this embodiment, surface 162 of package 173 may be mounted to surface 155 of circuit board 106 such that surface 162 may cover, at least in part, surface 155, or vice versa. For example, as shown in FIG. 3, surface 162 may be undersized compared to surface 155, and surface 162 may be mounted on surface 155 so as to be centered within the boundaries of surface 155. Alternatively, without departing from this embodiment, surface 162 and surface 155 may have substantially identical or identical respective dimensions and/or surface areas, such that, in module 100, surface 162 may substantially or entirely cover surface 155. Further alternatively, without departing from this embodiment, surface 155 may be undersized compared to surface 162.

Figure 4:
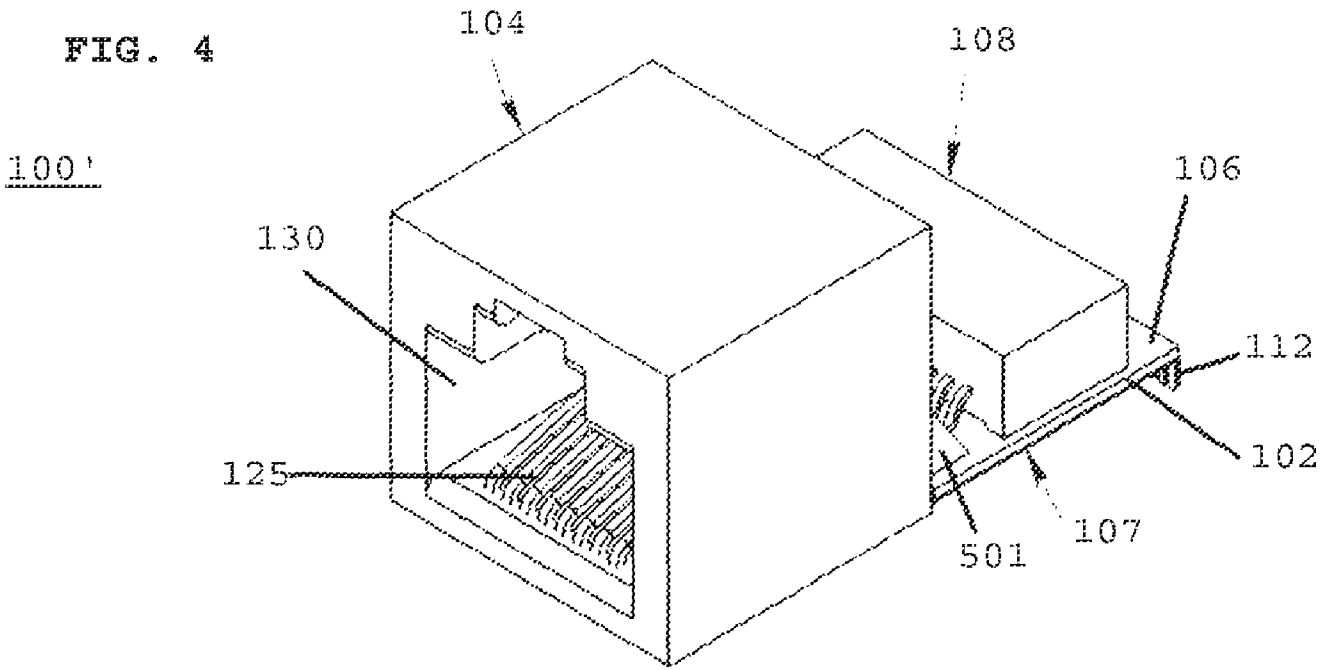
FIG. 4 illustrates a perspective view of a variation of an integrated module in an embodiment.
Figure 5:
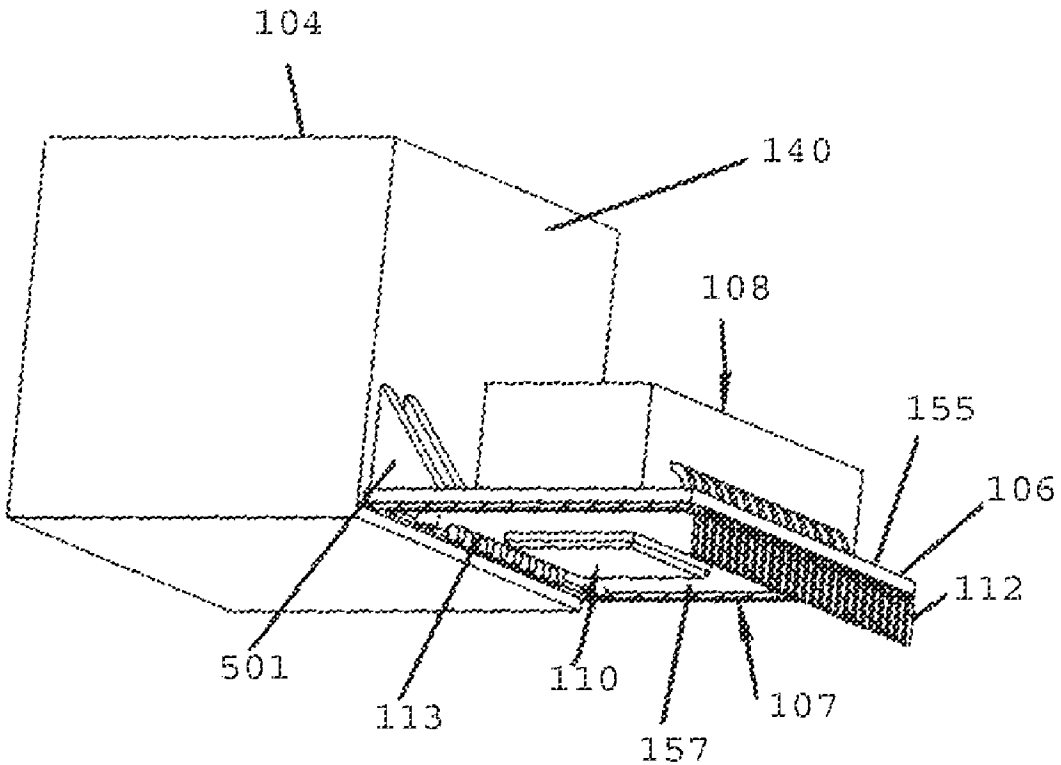
FIG. 5 illustrates another perspective view of the variation of FIG. 4.

FIGS. 4 and 5 illustrate an integrated module 100' that is a variation, without departing from this embodiment, of module 100. Except as stated herein, the construction, components, and/or operation of module 100' may be substantially identical or identical to the construction, components, and/or operation of module 100. In module 100', instead of being mounted to surface 140 by surface 157 and/or chipset 110, substrate 107 and/or circuit board 106 are mounted to surface 140 such that substrate 107 and/or board 106 are cantilevered at an angle (symbolically referred to by "$\alpha$" in FIG. 5) from surface 140. In this embodiment, the angle $\alpha$ may be or may be about 90 degrees. Module 100' may comprise one or more physical supports 501 to provide additional structural support to mount circuit board 106 and/or substrate 107 to surface 140.

Thus, in this embodiment, an integrated module may include a physical layer network device and a cable connector receptacle. The physical layer network device may be physically and electrically coupled to the cable connector receptacle. The physical layer network device may include a circuit board that may be directly physically coupled to the receptacle. The circuit board also may be electrically coupled to the receptacle.

In this embodiment, the circuit board may include a first surface, and the receptacle may include a second surface. The first surface may be mounted to the second surface such that the first surface covers the second surface. Alternatively, in this embodiment, the circuit board may be mounted to the second surface so as to extend at an angle (e.g., a right angle) from the second surface. The integrated module may include a physical layer isolation module that may be physically mounted to and in intimate contact with a third surface of the circuit board that is opposite to the first surface.

Advantageously, module 100 may exhibit a reduced cumulative footprint and/or consume less total motherboard surface area than might be the case if the module 100 did not comprise the physical network layer device, receptacle, and/or isolation module 108 (e.g., if the physical network layer device, receptacle, and/or isolation module 108 constituted separate, standalone entities having individual footprints that consumed respective motherboard surfaces areas). Also advantageously, module 100' may be easier to manufacture than module 100, but still may exhibit a reduced cumulative footprint and/or consume less total motherboard surface area.

Many modifications, variations, and alternatives are possible without departing from this embodiment. For example, although not shown in Figures, module 100' may comprise a separate housing enclosing, at least in part, the surface 155 of circuit board 106 and isolation module 108. Accordingly, this disclosure should be viewed broadly as encompassing all such modifications, variations, and alternatives.

What is claimed is:

1. An apparatus comprising:

an integrated module that includes a physical layer network device and a cable connector receptacle, the physical layer network device being physically and electrically coupled to the cable connector receptacle, the physical layer network device including a circuit board, the circuit board being directly physically coupled to the receptacle, the circuit board also being electrically coupled to the receptacle, the integrated module further comprising a physical layer isolation module that electrically couples the circuit board to the receptacle, the isolation module being physically mounted both to the receptacle and to the circuit board, the isolation module being to provide insertion loss and return loss in accordance with a communication protocol.

2. The apparatus of claim 1, wherein:

the circuit board includes a first integrated circuit chipset and a lead frame, the first chipset being to perform, at least in part, one or more physical layer network operations, the lead frame being to electrically couple the first chipset to a second integrated circuit chipset via at least one board-level interconnect.

3. The apparatus of claim 2, wherein:

the second integrated circuit chipset is mounted to a motherboard that includes, at least in part, the at least one interconnect;

the receptacle comprises an RJ45 connector; and the at least one interconnect comprises a peripheral component interconnect express interconnect.

4. The apparatus of claim 1, wherein:

the receptacle includes an opening to receive a connector jack and an external surface, the circuit board having a first surface and a second surface, the first surface being opposite to the second surface, the first surface being physically mounted to and in intimate contact with the external surface, an integrated circuit chipset being mounted to the first surface; and the physical layer isolation module is physically mounted to and in intimate contact with the second surface.

5. The apparatus of claim 1, wherein:

the receptacle includes an opening to receive a connector jack and also includes an external surface, the circuit board having a first surface and a second surface, the first surface being opposite to the second surface, the circuit board including an integrated circuit chipset that is mounted to the first surface, the circuit board being mounted to the external surface so as to extend at an angle from the external surface; and the physical layer isolation module is physically mounted to and in intimate contact with the second surface.

6. An apparatus comprising:

an integrated module that includes a physical layer network device and a cable connector receptacle, the physical layer network device being physically and electrically coupled to the cable connector receptacle, the physical layer network device including a circuit board that includes a first surface, the receptacle including a second surface, and the first surface being mounted to the second surface such that the first surface covers the second surface, the integrated module further comprising a physical layer isolation module that electrically couples the circuit board to the receptacle, the isolation module being physically mounted both to the receptacle and to the circuit board, the isolation module being to provide insertion loss and return loss in accordance with a communication protocol.

7. The apparatus of claim 6, wherein:

the first surface and the second surface have identical dimensions; and the first surface entirely covers the second surface.

8. The apparatus of claim 6, wherein:

the first surface is undersized compared to the second surface.

9. An apparatus comprising:

an integrated module that includes a physical layer isolation module and a physical layer network device, the physical layer isolation module including a first surface, the physical layer network device including a circuit board that includes a second surface, the first surface being mounted to the second surface such that the first surface covers the second surface, the physical layer isolation module being electrically coupled to the circuit board and to be electrically coupled to a receptacle, the isolation module to be physically mounted to the receptacle and being physically mounted to the circuit board, the isolation module being to provide insertion loss and return loss in accordance with a communication protocol.

10. The apparatus of claim 9, wherein:

the first surface is undersized compared to the second surface.

11. The apparatus of claim 9, wherein:

the apparatus also comprises a cable connector receptacle having a third surface;

the circuit board includes a fourth surface; and the fourth surface being mounted to the third surface such that the fourth surface covers the third surface.

12. The apparatus of claim 11, wherein:

the third surface and the fourth surface have identical dimensions; and the fourth surface entirely covers the third surface.

13. The apparatus of claim 11, wherein:

the fourth surface is undersized compared to the third surface.

14. The apparatus of claim 11, wherein:

the circuit board also comprises a lead frame coupled to the physical layer isolation module and to be coupled to an integrated circuit chipset via at least one board-level interconnect.

* * * * *